US005824460A

United States Patent [19]

Dickerson

[11] Patent Number: 5,824,460

[45] Date of Patent: Oct. 20, 1998

[54] SYMMETRICAL RADIOGRAPHIC ELEMENTS FOR GASTROINTESTINAL TRACT IMAGING

[75] Inventor: Robert E. Dickerson, Hamlin, N.Y.

[73] Assignee: Eastman Kodak Company, Rochester, N.Y.

[21] Appl. No.: 911,788

[22] Filed: Aug. 14, 1997

[51] Int. Cl.[6] ..... G03C 1/46; G03C 5/16; G03C 1/035

[52] U.S. Cl. ..... 430/502; 430/508; 430/509; 430/966; 430/438; 430/604; 430/567

[58] Field of Search ..... 430/502, 508, 430/509, 966, 604, 438, 567

[56] References Cited

U.S. PATENT DOCUMENTS

| | | | |
|---|---|---|---|
| 4,803,150 | 2/1989 | Dickerson et al. | 430/502 |
| 4,900,652 | 2/1990 | Dickerson et al. | 430/502 |
| 4,994,355 | 2/1991 | Dickerson et al. | 430/509 |
| 5,108,881 | 4/1992 | Dickerson et al. | 430/502 |
| 5,449,599 | 9/1995 | Heremans | 430/567 |
| 5,470,700 | 11/1995 | Marui | 430/567 |
| 5,576,156 | 11/1996 | Dickerson | 430/502 |
| 5,639,591 | 6/1997 | Adachi | 430/567 |
| 5,716,774 | 2/1998 | Dickerson et al. | 430/571 |

*Primary Examiner*—Mark F. Huff
*Attorney, Agent, or Firm*—Carl O. Thomas

[57] ABSTRACT

A dual-coated radiographic element is disclosed that is capable of providing improved gastrointestinal tract images. Specifically, the radiographic elements are capable of simultaneously providing a maximum density of less than 3.0, a contrast in the range of from 1.0 to 2.0 over a lower exposure region (typically achieved by adding barium to the gastrointestinal tract) extending over an exposure range of 0.3 log E, a contrast of in the range of from 1.0 to 2.0 over a higher exposure region (typically achieved by adding an effervescent substance to the gastrointestinal tract) extending over an exposure range of 0.6 log E, and a contrast greater than 3.5 over an intermediate exposure region extending over an exposure range of 0.6 log E. To accomplish this, underlying and overlying spectrally sensitized tabular grain emulsion layers are coated on each major surface of a support. The underlying emulsion layers contain a processing solution decolorizable dye to reduce crossover to less than 15 percent and a lower speed polydisperse tabular grain emulsion containing rhodium as a dopant. The overlying emulsion layers contain a blend of higher speed polydisperse and intermediate speed monodisperse tabular grain emulsions. The radiographic elements are fully fore-hardened with total hydrophilic colloid coverages per side limited to less than 35 mg/dm$^2$ to allow processing in less than 45 seconds.

8 Claims, No Drawings

SYMMETRICAL RADIOGRAPHIC ELEMENTS FOR GASTROINTESTINAL TRACT IMAGING

FIELD OF THE INVENTION

The invention relates to radiographic elements containing radiation-sensitive silver halide emulsions adapted to be exposed by a pair of intensifying screens.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "normalized molar concentration" in referring to rhodium concentrations based on silver, indicates the number of gram-molecular weights of rhodium present per gram-molecular weight of silver, divided (normalized) by the number of rhodium atoms present in the rhodium containing molecule.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as the standard deviation ($\sigma$) of grain ECD divided by mean grain ECD. COV is multiplied by 100 when stated as a percentage.

The term "log E" represents the log of exposure, measured in lux-seconds.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The term "crossover" refers to the light emitted by an intensifying screen mounted adjacent one side of a dual-coated radiographic element that is absorbed by one or more emulsion layers on the opposite side of the radiographic element support.

The term "symmetrical" in referring to radiographic elements indicates that the front and back sides of the elements have interchangeable (usually identical) imaging properties.

The term "asymmetrical" in referring to radiographic elements indicates that the front and back sides of the elements differ significantly in their imaging properties.

The term "overall processing" refers to processing that occurs between the time an image-wise exposed element is introduced into a processor and the time the element emerges dry. The processing steps include development, fixing, washing and drying.

The term "rapid access processing" refers to overall processing in less than 90 seconds.

The term "fully forehardened" means that the hydrophilic colloid layers are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

*Research Disclosure* is published by Kenneth Mason Publications, Ltd., Dudley House, 12 North St., Emsworth, Hampshire P010 7DQ, England.

BACKGROUND

In medical diagnostic imaging X-radiation is passed through a portion of a patient's anatomy. The pattern of X-radiation that passes through the patient is recorded in one or more radiation-sensitive emulsion layers of a radiographic film. To reduce the amount of X-radiation to which the patient must be subjected, the radiographic element is commonly dual-coated—that is, emulsion layers are coated on the front and back sides of the support. This reduces the amount of X-radiation required for imaging by half. A much larger reduction in X-radiation exposure is realized by using an intensifying screen to absorb X-radiation and emit light to the radiographic element for capture by a silver halide emulsion layer. Dual-coated radiographic elements are usually placed between a pair of intensifying screens and mounted in a cassette for exposure. With this arrangement the patient's exposure can be less than one twentieth of that which would otherwise be required to imagewise expose a single emulsion layer directly by X-radiation exposure. For most applications the speed advantage (X-radiation exposure reduction) more than offsets reductions in image sharpness attributable to crossover.

There is no single radiographic element that adequately serves all medical diagnostic needs. Different portions of the anatomy differ widely in their X-radiation absorptions. For example, bones absorb X-radiation to a much greater extent than soft tissue. The lungs, which are filled with air, absorb much less X-radiation than the heart. Further, the types of features sought to be identified often dictate imaging requirements. A clean break in a bone is much more easily seen that a tiny point of precancerous microcalcification in breast tissue or other lesions in soft tissue.

The gastrointestinal tract often requires examination for stomach and intestinal benign and cancerous growths. There is often little difference in X-radiation absorption between healthy gastrointestinal tract tissue and the aberrant growths sought to be identified. Fortunately, in gastrointestinal tract examinations compounds of barium, an alkaline earth metal with a large nucleus and hence a high X-radiation stopping capacity, and gas releasing effervescent substances, which stop little radiation, can be introduced to produce large differences X-radiation absorptions.

For example, in stomach examinations a patient typically swallows a combination of an effervescent substance and a barium compound. The barium compound is first received by the fundus of the stomach and then slowly released. As release occurs the barium compound flows primarily along the troughs in the folds of the body of the stomach and is collected at the duodenal bulb. Hence some areas, such as the fundus and duodenal bulb have high levels of barium and exhibit high X-radiation absorptions while other areas, such as the ridges of the stomach folds, retain little barium and absorb low levels of X-radiation while still other areas, such as the troughs in the body of the stomach, have intermediate levels of barium and exhibit intermediate X-radiation absorptions.

In a well taken stomach radiograph an almost three dimensional impression is created of the body of the stomach, allowing aberrant structure on the inner lining of the stomach to be seen as interruptions or diversions of the barium flow pattern.

Unfortunately, with radiographic elements that are currently available for gastrointestinal imaging it is not possible to capture image detail in both the areas that are (1) primarily gas filled containing low levels of barium or (2) areas in which barium is collected or concentrated. Areas (1) often appear as featureless black areas in the radiograph, since a high proportion of X-radiation has penetrated the anatomy to expose the radiographic element while areas (2) often appear as featureless white areas, since very little X-radiation is transmitted through the barium rich regions of the anatomy.

The following patents illustrate tabular grain emulsions employed in dual-coated radiographic element formats:

The types of radiographic elements most generally used for medical diagnostic imaging, with variations for specific diagnostic applications, are dual-coated elements that contain tabular grain emulsion layers on the front and back sides of the support. For example, Dickerson et al U.S. Pat. No. 4,900,652 discloses a radiographic element which is capable of producing maximum densities in the range of from 3 to 4, exhibits reduced crossover and low wet pressure sensitivity, and can be fully processed in a rapid transport processor in less than 90 seconds. The radiographic element is comprised of a spectrally sensitized tabular grain emulsion layer on each opposite side of a transparent film support and processing solution decolorizable dye particles in hydrophilic colloid layers interposed between the emulsion layers and the support Hydrophilic colloid on each side of the support is in the range of from 35 to 65 mg/dm$^2$, with the interposed layer containing hydrophilic colloid in the amount of at least 10 mg/dm$^2$.

Dickerson et al significantly advanced the state of the art. The spectrally sensitized tabular grain emulsion reduced crossover levels from 30 percent to approximately 20 percent. The dye particles further reduced crossover to less than 10 percent, with the capability of essentially eliminating crossover. The tabular grain emulsions also provided high covering power, allowing full forehardening and lower silver coverages to reach maximum image densities in the range of from 3 to 4. Dickerson et al discloses 35 mg/dm$^2$ of hydrophilic colloid on each major surface of the support to be the minimal amount compatible with achieving low wet pressure sensitivity.

Dickerson U.S. Pat. No. 5,576,156 discloses a radiographic element having emulsion layers coated on opposite surfaces of a transparent film support. To facilitate rapid processing the emulsion layers are fully forehardened and less than 35 mg/dm$^2$ of hydrophilic colloid is coated on each major surface. To reduce crossover and hydrophilic colloid, emulsions on the opposite sides of the support are each divided into two layers with the layer coated nearest the support containing a particulate dye capable of being decolorized during processing. Particulate dye and silver halide grains together account for between 30 and 70 percent of the total weight of the emulsion layers. Combined with the use of spectrally sensitized tabular grain emulsions crossover can be reduced to less than 15 percent while processing can be completed in less than 45 seconds. The distribution of hydrophilic colloid and silver halide grains chosen achieves low wet pressure sensitivity.

Dickerson and Bunch U.S. Patent successfully achieved simultaneous imaging of heart and lung areas of the thoracic cavity by combining low crossover with an asymmetrical coating format. First hydrophilic colloid layers coated nearest each major surface of a support contain a particulate processing solution decolorizable dye. On one side of the support a relatively high contrast emulsion layer was coated for lung imaging and on the other side of the support a relatively low contrast film was coated for heart imaging. It was demonstrated that adequate contrasts for both heart and lung imaging could be simultaneously obtained.

While advancing the state of the art and finding immediate commercial use, the radiographic elements of Dickerson and Bunch nevertheless have posed some disadvantages. First, these radiographic elements are asymmetrical—that is, the film has front and back sides that differ in their imaging properties. To get reproducible results it is necessary that the front and back orientation of the radiographic element as it is mounted in a cassette between a pair of intensifying screens must not change. Hence, the risk of operator error or the necessity of an additional feature to obviate the risk of misorientation.

Second, these radiographic elements, while capable of rapid access processing, are not capable of processing at the significantly lower overal processing times now being increasingly demanded by users.

SUMMARY OF THE INVENTION

The purpose of this invention is to provide a radiographic element that better serves gastrointestinal tract imaging requirements. Specifically, it is a purpose of this invention to provide sharp, well defined images that can be obtained with overall processing times of less than 45 seconds and, in most instances, less than 30 seconds. It is a further purpose of this invention to allow a greater dynamic latitude of diagnostic imaging. That is, it is intended to provide radiographic elements that make possible gastrointestinal tract images that concurrently produce diagnostically useful detail in both high and low density image regions and concurrently provide image sharpness and contrast in the mid-scale region of exposure that can equal the best currently available performance of gastrointestinal imaging films.

In one aspect this invention is directed to a medical diagnostic radiographic element comprised of a film support capable of transmitting radiation to which the radiographic element is responsive having first and second major surfaces and, coated on each of the major surfaces, fully forehardened processing solution permeable hydrophilic colloid layers including underlying and overlying superimposed spectrally sensitized radiation-sensitive tabular grain silver halide emulsion layers, the overlying emulsion layer being coated over the underlying emulsion layer, the overlying emulsion layer being coated over the underlying emulsion layer, the underlying emulsion layers additionally including a particulate dye (a) capable of absorbing radiation to which the silver halide grains are responsive, (b) present in an amount sufficient to reduce crossover to less than 15 percent, and (c) capable of being substantially decolorized during processing, wherein, to facilitate medical diagnostic imaging of the gastrointestinal tract the radiographic element is constructed to provide less than 35 mg/dm$^2$ of hydrophilic colloid on each major surface of the support, a maximum density of less than 3.0, a contrast in the range of from 1.0 to 2.0 over a lower exposure region extending over an exposure range of 0.3 log E, a contrast greater than 3.5 over an intermediate exposure region extending over an exposure range of 0.6 log E, and a contrast of in the range of from 1.0 to 2.0 over a higher exposure region extending over an exposure range of 0.3 log E, where E is in each occurrence exposure in lux-seconds, the underlying emulsion layers being comprised of a lower speed emulsion that contributes to image formation in the higher exposure region, the silver halide grains of the lower speed emulsion exhibiting a coefficient of variation of greater than 30 percent and accounting for from 10 to 40 percent of the silver halide grains present in the underlying and overlying emulsion layers, the radiation-sensitive silver halide grains in the second emulsion layers being provided by a blend of a higher speed tabular grain emulsion component responsible for contrast in the lower exposure region and an intermediate speed tabular grain emulsion component responsible for imparting a contrast of greater than 3.5 in the intermediate exposure region, the silver halide grains of the higher speed emulsion component having a coefficient of variation of greater than 30 percent, and the silver halide grains of the intermediate speed emulsion component accounting for from 30 to 60 percent of the silver halide grains in the underlying and overlying emulsion layers, having a coefficient of variation of less than 15 percent, and containing on a molar basis rhodium in an amount of less than $1\times10^{-7}$ based on silver, the recited coefficient of variation in each instance being based on grain equivalent circular diameters.

DESCRIPTION OF PREFERRED EMBODIMENTS

Assembly A

This is an assembly of a radiographic element according to the invention positioned between two intensifying screens.

| | | |
|---|---|---|
| FS | Front Screen | |
| | SS1 | Screen Support |
| | FLE | Front Luminescence Emitting Layer |
| RE | Radiographic Element | |
| | FE2 | Overlying Front Hydrophilic Colloid Layer |
| | FE1 | Underlying Front Hydrophilic Colloid Layer |
| | S | Support |
| | | S1 Subbing Layer |
| | | TF Transparent Film |
| | | S2 Subbing Layer |
| | BE1 | Underlying Back Hydrophilic Colloid Layer |
| | BE2 | Overlying Back Hydrophilic Colloid Layer |
| BS | Back screen | |
| | BLE | Back Luminescence Emitting Layer |
| | SS2 | Screen Support |

Assembly A is shown comprised of a medical diagnostic radiographic element RE satisfying gastrointestinal tract imaging requirements positioned between front and back intensifying screens FS and BS comprised of supports SS1 and SS2 and layers FLE and BLE that absorb X-radiation and emit light.

Located between the screens when intended to be image-wise exposed is radiographic element RE satisfying the requirements of the invention. The radiographic element is comprised of a support S, which is usually a transparent film TF and is frequently blue tinted. To facilitate coating onto the transparent film, subbing layers S1 and S2 are shown. Subbing layers S1 and S2 are usually employed to improve adhesion of each underlying emulsion layer to the support, but are not essential for all types of transparent films. The transparent film and the subbing layers are all transparent to light emitted by the intensifying screens and are also processing solution impermeable. That is, they do not ingest water during processing and hence do not contribute to the "drying load"—the water that must be removed to obtain a dry imaged element.

Underlying and overlying hydrophilic colloid layers FE1 and FE2, respectively, are coated on the major surface of the support positioned adjacent the front intensifying screen. Similarly, underlying and overlying hydrophilic colloid layers BE1 and BE2 are coated on the major surface of the support positioned adjacent the back intensifying screen. Also usually present, but not shown, are hydrophilic colloid layers, referred to as surface overcoats, that overlie FE2 and BE2 and perform the function of physically protecting the emulsion layers during handling and processing. In addition to hydrophilic colloid the overcoats can contain matting agents, antistatic agents, lubricants and other non-imaging addenda at or near the surface of the element. It is also common practice to coat a hydrophilic colloid interlayer between a surface overcoat and underlying emulsion layers. The interlayer can contain the same types of addenda as the surface overcoat, but is also commonly free of addenda, thereby acting primarily simply to provide a physical separation between the surface overcoat and its addenda and the emulsion layers.

The medical diagnostic radiographic elements of the invention satisfying gastrointestinal tract imaging requirements differ from radiographic elements previously available in the art by offering a combination of advantageous characteristics never previously realized in a single radiographic element:

(1) Full forehardening.

(2) Symmetrical format.

(3) Crossover of less than 15 percent.

(4) Processing in less than 45 seconds.

(5) Low wet pressure sensitivity.

(6) Relatively high levels of sensitivity.

(7) Improved image contrasts simultaneously realizable in barium poor and barium rich regions of the gastrointestinal tract.

Being able to realize characteristic (7) in combination with remaining characteristics (1)–(6) has never previously been achieved.

The radiographic element RE is fully forehardened. This better protects the radiographic element from damage in handling and processing and simplifies processing by eliminating any necessity of completing hardening during processing. Full forehardening is achieved by hardening the hydrophilic colloid layers. The levels of forehardening of a fully forehardened radiographic element are similar to those employed in forehardening photographic elements. A summary of vehicles for photographic elements including hydrophilic colloids, employed as peptizers and binders, and useful hardeners is contained in *Research Disclosure*, Vol. 389, September 1996, Item 38957, Section II. Vehicles, vehicle extenders, vehicle-like addenda and vehicle related addenda. Preferred vehicles for the hydrophitic colloid layers FE1, FE2, BE1 and BE2 as well as protective overcoats, if included, are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis (vinylsulfonyl) class of hardeners, such as bis(vinylsulfonyl)

alkylether or bis(vinylsulfonyl)alkane hardeners, where the alkyl moiety contains from 1 to 4 carbon atoms.

For the radiographic element to be capable of forming an image, it must include at least one radiation-sensitive silver halide emulsion. The fully fore-hardened characteristic (1) restricts the choices of the silver halide emulsions in the following manner: It is well recognized in the art that silver image covering power can decline as a function of increased levels of forehardening. Covering power is expressed as image density divided by silver coating coverage. For example, Dickerson U.S. Pat. No. 4,414,304 defines covering power as 100 times the ratio of maximum density to developed silver, expressed in mg/dm$^2$. Dickerson recognized that tabular grain emulsions are less susceptible to covering power reduction with increasing levels of forehardening.

If the hydrophilic colloid layers are not fully forehardened, excessive water pick up during processing prevents processing in less than 45 seconds, characteristic (4). If non-tabular grain emulsions are substituted for tabular grain emulsions, full forehardening requires excessive amounts of silver and characteristics (4) and (5) cannot be both realized. If the hydrophilic colloid is increased in proportion to the increase in silver, processing cannot be completed in less than 45 seconds. If silver is increased without increasing the hydrophilic colloid, the processed radiographic element will show localized density marks indicative of roller pressure applied in passing the exposed element through the processor, generally referred to as wet pressure sensitivity. Tabular grain emulsions frequently display higher levels of wet pressure sensitivity than non-tabular grain emulsions.

To improve gastrointestinal tract imaging (7) in a symmetrical format (2), a unique combination of tabular grain emulsions must be employed. The overlying emulsion layers F2 and B2 contain a blend of higher speed and intermediate speed tabular grain emulsions. The underlying emulsion layers F1 and B1 contain a lower speed tabular grain emulsion accounting for from 10 to 40 percent of the total silver present in all of the radiation-sensitive emulsion layers. The COV of grain size (ECD) is greater than 30 percent in the higher and lower speed tabular grain emulsions and less than 15 percent in the intermediate speed tabular grain emulsion.

The emulsions provide a contrast in the range of from 1.0 to 2.0 over a lower exposure region extending over an exposure range of 0.3 log E, a contrast of greater than 3.5 over an intermediate exposure region extending over an exposure range of 0.6 log E, and a contrast in the range of from 1.0 to 2.0 over a higher exposure region extending over an exposure range of 0.3 log E.

Tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. It is therefore preferred in terms of achieving characteristic (4). When characteristics (4) and (6) are considered together, silver chlorobromide and silver bromide compositions are preferred.

The tabular grain emulsions are preferably chosen so that tabular grains having thicknesses of less than 0.3 $\mu$m, most preferably less than 0.2 $\mu$m, in thickness account for greater than 70 percent and most preferably at least 90 percent of total grain projected area. Although the covering power of the tabular grains increases as their thickness is decreased, it is usually preferred to maintain average tabular grain thicknesses of at least about 0.1 $\mu$m to avoid undesirably warm image tones in the fully processed radiographic elements. It is generally recognized that tabular grain emulsions useful for imaging can have mean ECD's ranging up to about 10 $\mu$m, but in practice mean ECD's rarely exceed 5 $\mu$m and are typically less than 3 $\mu$m. The choice of mean grain sizes (ECD's) is dictated by balancing imaging speed and granularity (noise). Both speed and granularity are known to increase with increasing grain sizes. However, as taught by Kofron et al U.S. Pat. No. 4,439,520, spectrally sensitized tabular grain emulsions exhibit a superior speed-granularity relationship as compared to non-tabular grains coated at the same silver coverages. At the same mean ECD's greater than about 0.6 $\mu$m tabular grain emulsions are far superior to non-tabular grain emulsions in terms of granularity.

Conventional tabular grain emulsions having COV's of greater than 30 percent satisfying slow and fast emulsion requirements are illustrated in *Research Disclosure*, Item 38957, I. Emulsion grains and their preparation, B. Grain morphology, paragraphs (1)–(3).

Conventional high (>50 mole %) chloride tabular grain emulsions satisfying >30% COV emulsion requirements are illustrated by Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858;
Chang et al U.S. Pat. No. 5,252,452;
Maskasky U.S. Pat. No. 5,264,337;
Maskasky U.S. Pat. No. 5,272,052;
Maskasky U.S. Pat. No. 5,275,930;
Maskasky U.S. Pat. No. 5,292,632;
Maskasky U.S. Pat. No. 5,298,387;
Maskasky U.S. Pat. No. 5,298,388;
House et al U.S. Pat. No. 5,320,938;
Maskasky U.S. Pat. No. 5,558,982;
Maskasky U.S. Pat. No. 5,607,828

Conventional high (>50 mole %) bromide tabular grain emulsions compatible with >30% COV requirements are illustrated by the following citations:

Abbott et al U.S. Pat. No. 4,425,425;
Abbott et al U.S. Pat. No. 4,425,426;
Kofron et al U.S. Pat. No. 4,439,520;

Maskasky U.S. Pat. No. 4,713,320;

Ikeda et al U.S. Pat. No. 4,806,461;

Ohashi et al U.S. Pat. No. 4,835,095;

Makino et al U.S. Pat. No. 4,835,322;

Daubendiek et al U.S. Pat. No. 4,914,014;

Aida et al U.S. Pat. No. 4,962,015;

Black et al U.S. Pat. No. 5,219,720;

Dickerson et al U.S. Pat. No. 5,252,443;

Delton U.S. Pat. No. 5,310,644;

Chaffee et al U.S. Pat. No. 5,358,840;

Delton U.S. Pat. No. 5,372,927;

Maskasky U.S. Pat. No. 5,620,840.

Tabular grain emulsions satisfying intermediate speed emulsion requirements of the invention can be prepared with less than 15 percent coefficients of variation by employing techniques such as those taught by *Research Disclosure*, Item 38957, I. Emulsion grains and their preparation, E. Blends, layers and performance characteristics, paragraph (2). Preferred emulsion precipitations that produce tabular grain emulsions with COV's of less than 15 percent and, in preferred forms, less than 10 percent, are disclosed by Tsaur et al U.S. Pat. Nos. 5,147,771, 5,147,772, 5,147,773, 5,147,774 and 5,210,013; Kim et al U.S. Pat. Nos. 5,236,817 and 5,272,048; Sutton et al U.S. Pat. No. 5,300,413; and Mignot et al U.S. Pat. No. 5,484,697, the disclosures of which are here incorporated by reference.

It has been observed quite unexpectedly that superior, diagnostically useful contrasts at high, low and intermediate image densities are realized by the combination of COV percentages for component emulsions noted above and the addition of a rhodium dopant to the silver halide grains of the intermediate speed emulsion in a normalized molar concentration of less than $1\times10^{-7}$ based on silver and placement in the hydrophilic colloid layers FE1 and BE1 of a particulate dye to assist in crossover reduction to less than 15 percent. Whereas the art has heretofore regarded attaining increased contrasts with rhodium incompatible with maintaining high levels of imaging speed, it has been observed that by limiting the rhodium dopant to a normalized molar concentration of less $1\times10^{-7}$ based on silver, no significant reduction in speed is observed. Any amount of rhodium less than the $1\times10^{-7}$ concentration noted above that is capable of raising intermediate exposure range contrast to greater than 3.5 can be employed. In most instances it is contemplated that rhodium will be present in a normalized molar concentration of at least $1\times10^{-9}$, based on silver. Preferred rhodium normalized molar concentrations in the range of from $5\times10^{-9}$ to $5\times10^{-8}$ based on silver.

Any conventional rhodium compound known to be useful in doping silver halide grains can be employed in the practice of the invention. A variety of rhodium and other conventional silver halide grain dopants are disclosed by *Research Disclosure*, Item 38957, I. Emulsions and their preparation, D. Grain modifying conditions and adjustments, paragraphs (3), (4) and (5). Rhodium can be introduced as a simple salt, preferably a halide salt. It is now believed rhodium forms a hexacoordination complex prior to incorporation in the crystal lattice of a silver halide grain. Thus, in most instances rhodium hexahalides are preferred dopants, with up to two halide atoms being sometimes replaced with aquo ligands. Preferred halides in the rhodium compounds are chloride and bromide. Paragraphs (4) and (5) provide specific illustrations of other ligands, including organic ligands, that can be present in rhodium hexacoordination complexes.

The silver halide grains of the emulsions can, if desired, contain other conventional dopants. Speed increasing dopants, particularly shallow electron trapping (SET) dopants, such as those described in *Research Disclosure*, Vol. 367, Nov. 1994, Item 36736, and Olm et al U.S. Pat. No. 5,503,970, here incorporated by reference, are specifically contemplated. Conventional iridium dopants can also be employed. Iridium dopants, like rhodium dopants, are believed to enter the silver halide grain crystal lattice as hexacoordination complexes, most commonly iridium hexahalide coordination complexes. The iridium dopants can be present in any one or all of the emulsions. The SET dopants are particularly useful in the highest speed emulsion.

Conventional levels of silver are coated on both sides of the support. Since gastrointestinal tract imaging employs maximum densities of less than 3, silver coverages per side are contemplated ranging down to about 20 $mg/dm^2$ are contemplated. To facilitate overall processing in less than 45 seconds and, preferably, less than 30 seconds, it is contemplated to limit silver coverages to about 60 $mg/dm^2$ per side. A preferred silver coating range is from 25 to 50 $mg/dm^2$.

If all of the radiation-sensitive silver halide grains are spectrally sensitized, this alone is capable of reducing crossover to just less than 20 percent, as illustrated by Abbott et al U.S. Pat. Nos. 4,425,425 and 4,425,426 (hereinafter referred to collectively as Abbott et al).

All references to crossover percentages are based on the crossover measurement technique described in Abbott et al, here incorporated by reference. The crossover of a radiographic element according to the invention under the contemplated conditions of exposure and processing can be determined by substituting a black object (e.g., kraft paper) for one of the two intensifying screens. To provide a verifiable standard for measuring percent crossover, the exposure and processing described in the Examples, below, should be employed. Exposure through a stepped density test object exposes primarily the emulsion on the side of the radiographic element nearest the intensifying screen, but the emulsion on the side of the radiographic element farthest from the intensifying screen is also exposed, but to a more limited extent by unabsorbed light passing through the support. By removing emulsion from the side of the support nearest the intensifying screen in one sample and the side of the support farther from the intensifying screen in another sample, a characteristic curve (density vs. log E, where E is the light passing through the stepped test object) can be plotted for each emulsion remaining. The characteristic curve of the emulsion on the side farthest from the substituted light source is laterally displaced as compared to the characteristic curve of the emulsion on the side nearest the substituted light source. An average displacement ($\Delta\log E$) is determined and used to calculate percent crossover as follows:

$$\text{Percent Crossover} = \frac{1}{\text{antilog}(\Delta\log E)} \times 100 \qquad \text{(I)}$$

If screen emission is in the spectral region to which silver halide possesses native sensitivity, then the silver halide grains themselves contribute to light absorption and therefore crossover reduction. This occurs to a significant extent only at exposure wavelengths of less than 425 nm. Spectral sensitizing dye adsorbed to the grain surfaces is primarily relied upon for absorption of light emitted by the screens. The silver halide emulsions can contain any conventional spectral sensitizing dye or dye combination adsorbed to the grain surfaces. Typically dye absorption maxima are closely matched to the emission maxima of the screens so that maximum light capture efficiency is realized. To maximize speed (6) and minimize crossover (3), it is preferred to adsorb dye to the grain surfaces in a substantially optimum amount—that is, in an amount sufficient to realize at least 60 percent of maximum speed under the contemplated conditions of exposure and processing. To provide an objective standard for reference the conditions of exposure and processing set out in the Examples below can be employed. Illustrations of spectral sensitizing dyes useful with the radiographic elements of the invention are provided by Kofron et al U.S. Pat. No. 4,439,520, here incorporated by reference, particularly cited for its listing of blue spectral sensitizing dyes. Abbott et al U.S. Pat. Nos. 4,425,425 and 4,425,426 also illustrate the use of spectral sensitizing dyes to reduce crossover. A more general summary of spectral sensitizing dyes is provided by *Research Disclosure*, Item 38957, cited above, Section V. Spectral sensitization and desensitization, A. Sensitizing dyes.

To reduce crossover to less than 15 percent, including down to essentially no ("zero") crossover, it is contemplated to introduce additional dye capable of absorbing within the wavelength region of exposure into the hydrophilic colloid layers FE1 and BE1. The additional dye is chosen to absorb exposing light that is not absorbed by the silver halide grains and spectral sensitizing dye contained in hydrophilic colloid layers FE2 and BE2. If the additional dye is incorporated into the hydrophilic colloid layers FE2 and BE2 as well, the result is a marked reduction in photographic speed. In addition to its absorption properties the additional dye must be capable of being decolorization during processing.

Dickerson et al U.S. Pat. Nos. 4,803,150 and 4,900,652, here incorporated by reference, disclose particulate dyes capable of (a) absorbing radiation to which the silver halide grains are responsive to reduce crossover to less than 15 percent and (b) being substantially decolorized during processing. The particulate dyes can, in fact, substantially eliminate crossover. The mean ECD of the dye particles can range up to 10 $\mu$m, but is preferably less than 1 $\mu$m. Dye particle sizes down to about 0.01 $\mu$m can be conveniently formed. Where the dyes are initially crystallized in larger than desired particle sizes, conventional techniques for achieving smaller particle sizes can be employed, such as ball milling, roller milling, sand milling, and the like.

Since the hydrophilic colloid layers are typically coated as aqueous solutions in the pH range of from S to 6, most typically from 5.5 to 6.0, the dyes are selected to remain in particulate form at those pH levels in aqueous solutions. The dyes must, however, be readily soluble at the alkaline pH levels employed in photographic development. Dyes satisfying these requirements are nonionic in the pH range of coating, but ionic under the alkaline pH levels of processing. Preferred dyes are nonionic polymethine dyes, which include the merocyanine, oxonol, hemioxonol, styryl and arylidene dyes. In preferred forms the dyes contain carboxylic acid substituents, since these substituents are nonionic in the pH ranges of coating, but are ionic under alkaline processing conditions.

Specific examples of particulate dyes are described by Lemahieu et al U.S. Pat. No. 4,092,168, Diehl et al WO 88/04795 and EPO 0 274 723, and Factor et al EPO 0 299 435, Factor et al U.S. Pat. No. 4,900,653, Diehl et al U.S. Pat. No. 4,940,654 (dyes with groups having ionizable protons other than carboxy), Factor et al U.S. Pat. No. 4,948,718 (with arylpyrazolone nucleus), Diehl et al U.S. Pat. No. 4,950,586, Anderson et al U.S. Pat. No. 4,988,611 (particles of particular size ranges and substituent pKa values), Diehl et al U.S. Pat. No. 4,994,356, Usagawa et al U.S. Pat. No. 5,208,137, Adachi U.S. Pat. No. 5,213,957 (merocyanines), Usami U.S. Pat. No. 5,238,798 (pyrazolone oxonols), Usami et al U.S. Pat. No. 5,238,799 (pyrazolone oxonols), Diehl et al U.S. Pat. No. 5,213,956 (tricyanopropenes and others), Inagaki et al U.S. Pat. No. 5,075,205, Otp et al U.S. Pat. No. 5,098,818, Texter U.S. Pat. No. 5,274,109, McManus et al U.S. Pat. No. 5,098,820, Inagaki et al EPO 0 385 461, Fujita et al EPO 0 423 693, Usui EPO 0 423 742 (containing groups with specific pKa values), Usagawa et al EPO 0 434 413 (pyrazolones with particular sulfamoyl, carboxyl and similar substituents), Jimbo et al EPO 0 460 550, Diehl et al EPO 0 524 593 (having alkoxy or cyclic ether substituted phenyl substituents), Diehl et al EPO 0 524 594 (furan substituents) and Ohno EPO 0 552 646 (oxonols).

If all of the silver halide required for imaging is located in the hydrophilic colloid layers FE2 and BE2, it is impossible satisfy characteristics (4) and (5). If hydrophilic colloid is reduced to less than 35 mg/dm$^2$ per side, processing in less than 45 seconds (4) can be realized, but high levels of wet pressure sensitivity are observed. Wet pressure sensitivity is observed as uneven optical densities in the fully processed image, attributable to differences in guide roller pressures applied in rapid processing. If the amount of hydrophilic colloid in the layers FE2 and BE2 is increased to an extent necessary to eliminate visible wet pressure sensitivity, the radiographic element cannot be processed in less than 45 seconds.

It has been discovered that successful rapid processing and low levels of wet pressure sensitivity can be both realized if a portion of the spectrally sensitized radiation-sensitive silver halide relied upon for imaging is incorporated in the hydrophilic colloid layers FE1 and BE1. Surprisingly, as demonstrated in the Examples below, when a portion of the spectrally sensitized radiation-sensitive silver halide is coated in the hydrophilic colloid layers containing the particulate dye used for crossover reduction, fully acceptable photographic speeds can still be maintained. This is in direct contradiction to observations that particulate dye and silver halide emulsion blending in a single hydrophilic colloid result in unacceptably low levels of photographic speed. By incorporating both a portion of the silver halide emulsion and the particulate dye in hydrophilic colloid layers FE1 and BE1, it is possible to reduce the total coverage of hydrophilic colloid per side of the radiographic elements of the invention to less than 35 mg/dm$^2$, preferably less than 33 mg/dm$^2$ while satisfying characteristics (1)–(7). In preferred forms of the invention, the low levels of hydrophilic colloid per side allow processing characteristic (4) to be reduced to less than 35 seconds.

To satisfy characteristics (1)–(7), from 20 to 80 (preferably 30 to 70) percent of the total silver forming the radiographic element must be contained in the hydrophilic colloid layers FE2 and BE2. Similarly, from 20 to 80 (preferably 30 to 70) percent of the total silver forming the radiographic element must be contained in the hydrophilic colloid layers FE1 and BE1. It is generally preferred that at least 50 percent of the total silver forming the radiographic element be contained in the hydrophilic colloid layers FE2 and BE2.

In addition, to satisfy characteristics (1)–(7), the silver halide grains in hydrophilic colloid layers FE2 and BE2 account for from 30 to 70 (preferably 40 to 60) percent of the total weight of these layers. Similarly, in hydrophilic colloid layers FE1 and BE1 the silver halide grains and dye particles together account for from 30 to 70 (preferably 40 to 60) percent of the total weight of these layers.

Specific selections of remaining features of the radiographic element RE can take any convenient conventional form compatible with the descriptions provided. For example, transparent film supports and the subbing layers that are typically provided on their major surfaces to improve the adhesion of hydrophilic colloid layers are disclosed in *Research Disclosure*, Item 38957, Section XV. Supports and in *Research Disclosure*, Item 18431, Section XII. Film Supports. Chemical sensitization of the emulsions is disclosed in *Research Disclosure*, Item 36544, Section IV. Chemical sensitization and *Research Disclosure*, Item 18431, Section I.C. Chemical Sensitization/Doped Crystals. The chemical sensitization of tabular grain emulsions is more particularly taught in Kofron et al U.S. Pat. No. 4,429,520, here incorporated by reference.

The following sections of *Research Disclosure*, Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure*, Item 38957 summarize additional features that are applicable to the radiographic elements of the invention:

VII. Antifoggants and stabilizers

IX. Coating physical property modifying addenda

A. Coating aids

B. Plasticizers and lubricants

C. Antistats

D. Matting Agents

EXAMPLES

The invention can be better appreciated by consideration in connection with the following specific embodiments. The letters c and e are appended to element numbers to differentiate control and example radiographic elements. All coating coverages are in mg/dm$^2$, except as otherwise indicated.

Radiographic Element Ac

A conventional symmetric dual-coated radiographic imaging element was provided having the following format:

| |
|---|
| Surface Overcoat (SOC) |
| Interlayer (IL) |
| Emulsion Layer (EL) |
| Transparent Film Support |
| Emulsion Layer (EL) |
| Interlayer (IL) |
| Surface Overcoat (SOC) |

Surface Overcoat (SOC)

| Content | Coverage |
|---|---|
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The SOC layer on the back side of the support additionally contained a marker dye to allow visual verification of orientation, as described in Dickerson U.S. Pat. No. 5,252,443.

| Contents | Coverage |
|---|---|
| Interlayer (IL) | |
| Gelatin | 3.4 |
| AgI Lippmann (0.08 μm) | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Emulsion Layer (EL) | |
| Ag | 20.4 |
| Gelatin | 31 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether | 2.4% |

(based on wt. of gelatin in all layers of the front side of the support)

The emulsion layer contained a tabular grain silver bromide emulsion. The grains had a mean ECD of 2.0 μm and the tabular grains had a mean thickness of 0.13 μm. Tabular grains accounted for greater than 50 percent of total grain projected area. The COV of grain ECD was greater than 30 percent.

The emulsion was chemically sensitized with sodium thiosulfate, potassium tetrachloroaurate, sodium thiocyanate and potassium selenocyanate and spectrally sensitized with 400 mg/Ag mole of anhydro-5,5-dichloro-9-ethyl-3,3'-bis(3-sulfopropyl)oxacarbocyanine hydroxide, followed by the addition of 300 mg/Ag mole of KI.

Transparent Film Support

The transparent film support consisted of a conventional blue tinted polyester radiographic film support having a thickness of 177.8 μm.

Radiographic Element Bc

This radiographic element was identical to radiographic element Ac, except that the tabular grain silver bromide emulsion was replaced by blend of two polydisperse tabular grain silver bromide emulsions, each having a COV of greater than 30 percent. Both emulsions exhibited a mean tabular grain thickness of 0.13 μm. One of the tabular grain emulsions (A) exhibited a mean ECD of 2.0 μm while the other (B) exhibited a mean ECD of 1.3 μm. The emulsions were coated in an A:B silver ratio of 60:40. The emulsions were sensitized identically and all coating coverages were identical to those described for radiographic element A.

Radiographic Element Cc

This radiographic element was similar to radiographic element Ac, except that the single emulsion layer on each side was replaced by a pair of emulsion layers.

A symmetric dual-coated radiographic imaging element resulted having the following format:

| |
|---|
| Surface Overcoat (SOC) |
| Interlayer (IL) |
| Overlying Emulsion Layer (OEL) |

-continued

| |
|---|
| Underlying Emulsion Layer (UEL) |
| Transparent Film Support |
| Underlying Emulsion Layer (UEL) |
| Overlying Emulsion Layer (OEL) |
| Interlayer (IL) |
| Surface Overcoat (SOC) |

The transparent film support, surface overcoats and interlayers were identical to those described for radiographic element Ac.

Overlying Emulsion Layer (OEL)

| Contents | Coverage |
|---|---|
| Ag (faster speed emulsion) | 4.3 |
| Ag (intermediate speed emulsion) | 5.4 |
| Gelatin | 16.1 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |

The emulsion layer contained a blend of two tabular grain silver bromide emulsions. The tabular grains of both emulsions had a mean thickness of 0.13 μm. The grains of the faster speed emulsion had a mean ECD of 3.5 μm. The grains of the intermediate speed emulsion had a mean ECD of 2.0 μm. Tabular grains in each emulsion accounted for greater than 50 percent of total grain projected area. The COV of grain ECD in each emulsion was greater than 30 percent.

Underlying Emulsion Layer (UEL)

| Contents | Coverage |
|---|---|
| Ag (slower speed emulsion) | 4.8 |
| Gelatin | 8.1 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Dye XOC-1 | 1.1 |
| Bis(vinylsulfonylmethyl)ether | 2.4% |

(based on wt. of gelatin in all layers of the front side of the support)

Dye XOC-1 was 1-(4'-carboxyphenyl)-4-(4'-dimethylaminobenzylidene)-3-ethoxycarbonyl-2-pyrazolin-5-one.

The underlying emulsion layer contained a slower speed tabular grain silver bromide emulsion. The slower speed emulsion was identical to the intermediate speed emulsion of the overlying emulsion layer, except that its chemical sensitization was adjusted to provide a slower speed.

Except as indicated, the chemical and spectral sensitizations of the emulsions were as described for radiographic element Ac.

Radiographic Element Dc

This radiographic element was identical to radiographic element Cc, except that the intermediate speed emulsion was replaced by a monodisperse emulsion having a grain size COV of 10 percent. Mean grain ECD was 1.8 μm. The tabular grains had a mean thickness of 0.13 μm and accounted for greater than 90 percent of total grain projected area. Chemical and spectral sensitization of the intermediate speed tabular grain emulsion was as previously described.

Radiographic Element Ee

This radiographic element was identical to radiographic element Dc, except that the grains of the intermediate speed emulsion were doped with doped with $9.7\times10^{-9}$ mole per silver mole of rhodium introduced by addition of $(NH_4)_3RhCl_6$ during grain precipitation.

Evaluations

Samples of the dual-coated elements were simultaneously exposed on each side for 1/50 sec through a graduated density step tablet using a MacBeth™ sensitometer having a 500 watt General Electric DMX™ projector lamp calibrated to 2650° K and filtered through a Corning C4010™ filter (480–600 nm, 530 nm peak transmission).

The samples were processed using a Kodak X-Omat RA 480 processor. This processor can be set to any one of the overall processing cycles set out in Table I.

TABLE I

Cycle Times in Seconds

| Cycle | Extended | Standard | Rapid | KWIK | Super KWIK |
|---|---|---|---|---|---|
| Develop | 44.9 | 27.6 | 15.1 | 11.1 | 8.3 |
| Fix | 37.5 | 18.3 | 12.9 | 9.4 | 7.0 |
| Wash | 30.1 | 15.5 | 10.4 | 7.6 | 5.6 |
| Dry | 47.5 | 21.0 | 16.6 | 12.2 | 9.1 |
| Total | 160.0 | 82.4 | 55 | 40.3 | 30.0 |

The Super KWIK cycle employed the following developer, component concentrations, expressed in g/L:

| | |
|---|---|
| Hydroquinone | 32 |
| 4-Hydroxymethyl-4-methyl-1-phenyl-3-pyrazolidinone | 6.0 |
| Potassium bromide | 2.25 |
| 5-Methylbenzotriazole | 0.125 |
| Sodium sulfite | 160 |
| Water to 1 liter | |
| pH | 10.35 |

The developer for the remaining cycles are listed below, expressed in g/L:

| | |
|---|---|
| Hydroquinone | 30 |
| 4-Hydroxymethyl-4-methyl-1-phenyl-3-pyrazolidinone | 1.5 |
| Potassium hydroxide | 21.00 |
| 5-Methylbenzotriazole | 0.06 |
| Sodium bicarbonate | 7.5 |
| Sodium sulfite | 44.2 |
| Sodium metabisulfite | 12.6 |
| Sodium bromide | 35.0 |
| Water to 1 liter | |
| pH | 10 |

To compare the ability of the processor to dry the elements, film samples were flash exposed to provide a density of 1.0 when processed. As each film sample started to exit the processor, the processor was stopped, and the sample was removed from the processor. Roller marks were visible on the film in areas that had not dried. A film that was not dry as it left the processor was assigned a % dryer value of 100+. A film that exhibited roller marks from first encountered guide rollers, but not the later encountered guide rollers, indicating that the film had already dried when passing over the latter rollers, was assigned a % dryer value indicative of percentage of the rollers that were guiding undried portions of the film. Hence lower % dryer values indicate quicker drying film samples.

All of the radiographic elements were capable of successful (fully dried) processing with each of the cycles. However, it should be noted that to keep hydrophilic colloid levels per side at a tolerable level in radiographic elements Ac and Bc, which employed a single emulsion layer per side, it was not possible to incorporate a separate crossover control layer, as is typically undertaken. Lack of crossover control protection in elements Ac and Bc rendered the sharpness of the images they produced inferior to those obtained in radiographic elements Cc, Dc and Ee.

To permit crossover determinations samples of the Elements were exposed with a Lanex Regular™ green emitting intensifying screen in contact with one side of the sample and black kraft paper in contact with the other side of the sample. The X-radiation source was a Picker VGX653 3-phase X-ray machine, with a Dunlee High-Speed PX1431-CQ-150 kVp 0.7/1.4 focus tube. Exposure was made at 70 kVp, 32 mAs, at a distance of 1.40 m. Filtration was with 3 mm Al equivalent (1.25 inherent+1.75 Al); Half Value Layer (HVL)-2.6 mm Al. A 26 step Al step wedge was used, differing in thickness by 2 mm per step.

Processing of these samples was undertaken using the Standard processing cycle, although similar results could have been obtained with any cycle. By removing emulsion from the side of the support nearest the screen at some sample locations and from the side of the support opposite the screen at other sample locations the density produced on each side of the support at each step was determined. From this separate characteristic (density vs. log E) curves were plotted for each emulsion layer. The exposure offset between the curves was measured at three locations between the toe and shoulder portions of the curves and averaged to obtain Δ log E for use in equation (I), above.

The speed of the radiographic elements, measured at a density of 1.0 above $D_{min}$, was essentially similar, differing by less than 0.05 log E.

A comparison of features that differed significantly is summarized below in Table II.

TABLE II (deficient characterisitics highlighted)

| RE | UEL | % COV | OEL | $D_{max}$ | % XO | Rh | Contrast LER | Contrast IER | Contrast HER |
|---|---|---|---|---|---|---|---|---|---|
| Ac | | >30 | | **3.7** | **29** | No | 1.9 | 3.8 | **2.9** |
| Bc | | >30 | | **3.0** | **32** | No | 1.9 | 3.8 | 2.0 |
| Cc | >30 | | >30 | 2.6 | 10 | No | 1.9 | **3.2** | 1.9 |
| Dc | >30 | | >30 +10 | 2.5 | 10 | No | 1.7 | **3.5** | 1.9 |
| Ee | >30 | | >30 +7 | 2.5 | 10 | Yes | 1.9 | 3.8 | 1.5 |

% XO = Percent Crossover
LER = Lower exposure range (0.3 log E)
IER = Intermediate exposure range (0.6 log E)
HER = Higher exposure range (0.3 log E)

Radiographic elements Ac and Bc, which employed single emulsion layers on each side and no crossover control dye, so that processing times could be satisfied, both exhibited unacceptably high levels of crossover, which is reflected in a lack of image sharpness. In addition radiographic element Ac unacceptably high levels of maximum density and contrast in the high exposure range, which translates into an inability to see image detail in high barium concentration areas of the intestinal tract. Radiographic element Bc showed both maximum density and high exposure range contrast, just above acceptable levels.

Radiographic element Cc, which employed polydisperse emulsions in both the overlying and underlying emulsion layers as well as crossover control dye in underlying emulsion layers, satisfied maximum density, crossover, lower exposure range contrast, and higher exposure range contrast, but failed to provide adequate contrast in the intermediate exposure range. Lack of contrast in the intermediate exposure range translates into less than visually compelling images of diagnostically important areas in which barium is well distributed, such as the folds of the stomach.

Radiographic element Dc, which replaced a portion of the polydisperse emulsion in the overlying emulsion layer with a monodisperse emulsion, improved on the intermediate range contrast of element Cc, but fell short of reaching contrast levels of greater than 3.5.

Only radiographic element Ee, which replaced the monodisperse emulsion of element Dc with a rhodium doped monodispersed emulsion simultaneously satisfied each of maximum density, crossover, and contrasts in each of the low exposure, intermediate exposure and high exposure regions. Radiographic element was superior in overall imaging performance.

The invention has been described in detail with particular reference to preferred embodiments thereof, but it will be understood that variations and modifications can be effected within the spirit and scope of the invention.

What is claimed is:

1. A medical diagnostic radiographic element comprised of a film support capable of transmitting radiation to which the radiographic element is responsive having first and second major surfaces and, coated on each of the major surfaces, fully forehardened processing solution permeable hydrophilic colloid layers including underlying and overlying superimposed spectrally sensitized radiation-sensitive tabular grain silver halide emulsion layers, the overlying emulsion layer being coated over the underlying emulsion layer, the underlying emulsion layers additionally including a particulate dye (a) capable of absorbing radiation to which the silver halide grains are responsive, (b) present in an amount sufficient to reduce crossover to less than 15 percent, and (c) capable of being substantially decolorized during processing, WHEREIN, to facilitate medical diagnostic imaging of the gastrointestinal tract the radiographic element is constructed to provide less than 35 mg/dm$^2$ of hydrophilic colloid on each major surface of the support, a maximum density of less than 3.0, a contrast in the range of from 1.0 to 2.0 over a lower exposure region extending over an exposure range of 0.3 log E, a contrast greater than 3.5 over an intermediate exposure region extending over an exposure range of 0.6 log E, and a contrast of in the range of from 1.0 to 2.0 over a higher exposure region extending over an exposure range of 0.3 log E, where E is in each occurrence exposure in lux-seconds, the underlying emulsion layers being comprised of a lower speed emulsion that contributes to image formation in the higher exposure region, the silver halide grains of the lower speed emulsion exhibiting a coefficient of variation of greater than 30 percent and accounting for from 10 to 40 percent of the silver halide grains present in the underlying and overlying emulsion layers, the radiation-sensitive silver halide grains in the overlying emulsion layers being provided by a blend of a higher speed tabular grain emulsion responsible for contrast in the lower exposure region and an intermediate speed tabular grain emulsion component responsible for imparting a contrast of greater than 3.0 in the intermediate exposure region, the silver halide grains of the higher speed emulsion component having a coefficient of variation of greater than 30 percent, and the silver halide grains of the intermediate speed emulsion component accounting for from 30 to 60 percent of the silver halide grains in the underlying and overlying emulsion layers, having a coefficient of variation of less than 15 percent, and containing on a molar basis rhodium in an amount of less than $1\times10^{-7}$ based on silver, the recited coefficient of variation in each instance being based on grain equivalent circular diameters.

2. A gastrointestinal tract imaging radiographic element according to claim 1 wherein the intermediate speed emulsion contains rhodium in a normalized molar concentration of at least $1\times10^{-9}$ based on silver.

3. A gastrointestinal tract imaging radiographic element according to claim 2 wherein the rhodium dopant is present in a normalized molar concentration in the range of from $5\times10^{-9}$ to $5\times10^{-8}$ based on silver.

4. A gastrointestinal tract imaging radiographic element according to claim 1 wherein the particulate dye is present as particles capable of reducing crossover to at least 10 percent.

5. A gastrointestinal tract imaging radiographic element according to claim 1 wherein the tabular grains in each of the tabular grain emulsion layers have an average thickness of at least 0.1 $\mu$m.

6. A gastrointestinal tract imaging radiographic element according to claim 1 wherein the tabular grains in each of the tabular grain emulsion layers have a thickness of less than 0.2 $\mu$m account for at least 70 percent of total grain projected area in the tabular grain emulsions.

7. A gastrointestinal tract imaging radiographic element according to claim 1 wherein the radiographic element can be processed by the following processing cycle:

| | |
|---|---|
| developing | 11.1 seconds |
| fixing | 9.4 seconds |
| washing | 7.6 seconds |
| drying | 12.2 seconds |

employing a hydroquinone-pyrazolidinone developer.

8. A gastrointestinal tract imaging radiographic element according to claim 1 wherein the radiographic element can be processed by the following processing cycle:

| | |
|---|---|
| developing | 8.3 seconds |
| fixing | 7.0 seconds |
| washing | 5.6 seconds |
| drying | 9.1 seconds |

employing a hydroquinone-pyrazolidinone developer.

* * * * *